US008154374B2

(12) United States Patent
Eriksson et al.

(10) Patent No.: US 8,154,374 B2
(45) Date of Patent: Apr. 10, 2012

(54) TRANSFORMER WINDING AND A METHOD OF REINFORCING A TRANSFORMER WINDING

(75) Inventors: Tomas Eriksson, Smedjebacken (SE); Sebastian Jutäng, Sunnansjö (SE); Leif Olsson, Smedjebacken (SE); Kenneth Ågren, Ludvika (SE); Jan Anger, Ludvika (SE); Hans Persson, Idkerberget (SE); Erik Forsberg, Smedjebacken (SE); Curt Eggmark, Ludvika (SE); Christer Ericsson, Ludvika (SE); Bo Skansen, Nås (SE)

(73) Assignee: ABB Technology Ltd. (CH)

( * ) Notice: Subject to any disclaimer, the term of this patent is extended or adjusted under 35 U.S.C. 154(b) by 0 days.

(21) Appl. No.: 12/940,843

(22) Filed: Nov. 5, 2010

(65) Prior Publication Data

US 2011/0109420 A1 May 12, 2011

(30) Foreign Application Priority Data

Nov. 5, 2009 (EP) ..... 09175158

(51) Int. Cl.
*H01F 7/06* (2006.01)
*H01F 27/28* (2006.01)

(52) U.S. Cl. ..... 336/192; 336/180; 29/602.1

(58) Field of Classification Search ..... 336/192, 336/180, 182, 92; 29/602.1
See application file for complete search history.

(56) References Cited

U.S. PATENT DOCUMENTS

| | | | | |
|---|---|---|---|---|
| 3,659,033 | A | 4/1972 | Grimmer | |
| 4,538,131 | A * | 8/1985 | Baier et al. | 336/57 |
| 4,540,536 | A | 9/1985 | Altmann et al. | |
| 5,589,808 | A * | 12/1996 | Clark et al. | 336/92 |
| 7,128,869 | B2 * | 10/2006 | Habisreitinger et al. | 264/510 |
| 2003/0058076 | A1 | 3/2003 | Lanoue et al. | |
| 2004/0257188 | A1 * | 12/2004 | Younger et al. | 336/180 |
| 2008/0024256 | A1 * | 1/2008 | Pauley et al. | 336/92 |

FOREIGN PATENT DOCUMENTS

| | | | |
|---|---|---|---|
| EP | 1681691 | A1 | 7/2006 |
| EP | 1798740 | A1 | 6/2007 |
| FR | 1191964 | A | 10/1959 |
| WO | 9824098 | A1 | 6/1998 |
| WO | 9928926 | A2 | 6/1999 |
| WO | 2008027004 | A1 | 3/2008 |

OTHER PUBLICATIONS

European Search Report; Application No. EP 09 16 3088; Nov. 5, 2009; 6 pages.
European Search Report; Application No. EP 09 17 6377; Apr. 15, 2010; 7 pages.
European Search Report; Application No. EP 09 17 5158; Apr. 27, 2010; 4 pages.
Liang et al. in "Stability of Transformer's Whole Low Voltage Winding", Electrical Machines and Systems, International Conference on Electrical Machines and Systems 2003, vol. 1, pp. 302-304.

* cited by examiner

*Primary Examiner* — Anh Mai
(74) *Attorney, Agent, or Firm* — St. Onge Steward Johnston & Reens LLC

(57) ABSTRACT

A transformer winding having a conductor wound in a plurality of turns is disclosed, wherein the transformer winding includes a reinforcing part arranged at a winding transition in a manner so that the reinforcing part covers more than 180 degrees of the conductor circumference, whereby the bending strength of the conductor at the location of the reinforcing part is increased. The resistibility of the transformer winding against bending stress is hence improved.

15 Claims, 10 Drawing Sheets

200

200

TRANSFORMER WINDING AND A METHOD OF REINFORCING A TRANSFORMER WINDING

CROSS-REFERENCE TO RELATED APPLICATIONS

The present application claims priority of pending European patent application No. 09175158.6 filed on Nov. 5, 2009, the content of which is incorporated herein by reference.

FIELD OF THE INVENTION

The invention relates to the field of transformers for voltage transformation, and in particular to transformer windings.

BACKGROUND OF THE INVENTION

A current-carrying conductor in a magnetic field will experience a force corresponding to the cross product between the current and the magnetic field, this force often referred to as the magnetic Lorentz force. In a transformer, the magnetic Lorentz force results inter alia in an inward radial force on an inner winding and a corresponding outward radial force on an outer winding.

In the event of short circuit currents flowing in a transformer, the inward radial force on an inner transformer winding can be very high, and can cause considerable damage to the transformer. This phenomenon has been discussed in several papers, see for example Z. Liang et al. in "*Stability of Transformer's Whole Low Voltage Winding*", Electrical Machines and Systems, International Conference on Electrical Machines and Systems 2003, Vol. 1, pp. 302-304.

SUMMARY OF THE INVENTION

A problem to which the invention relates is how to improve the mechanical stability of a transformer winding against deformation caused by bending stress, for example in a short circuit situation.

This problem is addressed by a transformer winding having a conductor wound in a Plurality of turns. The transformer winding comprises: a reinforcing part arranged at a winding transition in a manner so that covers more than 180 degrees of the conductor circumference, whereby the bending strength of the conductor at the location of the winding transition is increased. The resistibility of the transformer winding against bending stress caused by compressive forces, occurring for example in a short circuit situation, is hereby improved. The bending stress that occurs upon short circuit at winding transitions, where the conductor path deviates from the regular winding path, is often a limiting factor for the entire winding dimensioning. Hence, by increasing the bending strength at a winding transition, larger transformer dimensions may be facilitated.

In one embodiment, the main component of the reinforcing part is a fibre reinforced polymer. Fibre reinforced polymers can conveniently be formed into a suitable shape, and provide adequate tensile and compressive strength.

The reinforcing part could advantageously be dimensioned so that the bending strength of the conductor is increased by at least 25% at the location of the reinforcing part. By increasing the bending strength of the conductor by at least 25% at a winding transition, it is often achieved that this winding transition will no longer be the weakest point of the transformer winding.

In one embodiment, the reinforcing part extends, in the axial direction of the conductor, a distance corresponding to less than a circumference of a winding turn.

A transformer winding may comprise a plurality of radial duct spacers spaced at a duct spacer distance along the circumferential direction of the winding. In one embodiment, the reinforcing part extends, in the axial direction of the conductor, a distance corresponding to 1-4 duct spacer distances.

In one embodiment, the reinforcing part includes a component providing semi-conducting properties to the reinforcing part, so that electrical shielding of the reinforcing part is achieved. When producing a reinforcing part, there is a risk that gas bubbles will form in the reinforcing part. By providing shielding to the reinforcing part it is achieved that less strict measures will be needed for avoiding that gas bubbles form in the reinforcing part upon production.

A transformer having a transformer winding as described above is furthermore disclosed. The transformer winding can advantageously form an inner winding of the transformer. Furthermore, the transformer winding can advantageously form a low voltage winding of the transformer. The transformer winding can be beneficial to many types of transformers, and in particular to a transformer of an electrical power rating of 25 MVA or more, since such transformers are exposed to very strong Lorentz forces upon short circuit.

In one embodiment, the conductor of the transformer winding is a continuously transposed cable conductor. Such conductors are often used in transformer windings, for example low voltage windings of transformers of electrical power rating of 25 MVA or higher. Continuously transposed cable conductors are generally not as resistant to bending stress as to compressive or tensile stresses. Hence, the invention can provide great improvements to such windings.

A method of increasing the bending strength of a transformer winding having a conductor is furthermore disclosed. Reinforcing fibres in a thermosetting polymer are arranged at a winding transition in a manner so that the reinforcing fibres form a reinforcing part extending around more than 180 degrees of the circumference of the conductor.

Further aspects of the invention are set out in the following detailed description and in the accompanying claims.

DETAILED DESCRIPTION OF THE INVENTION

Figure 1:
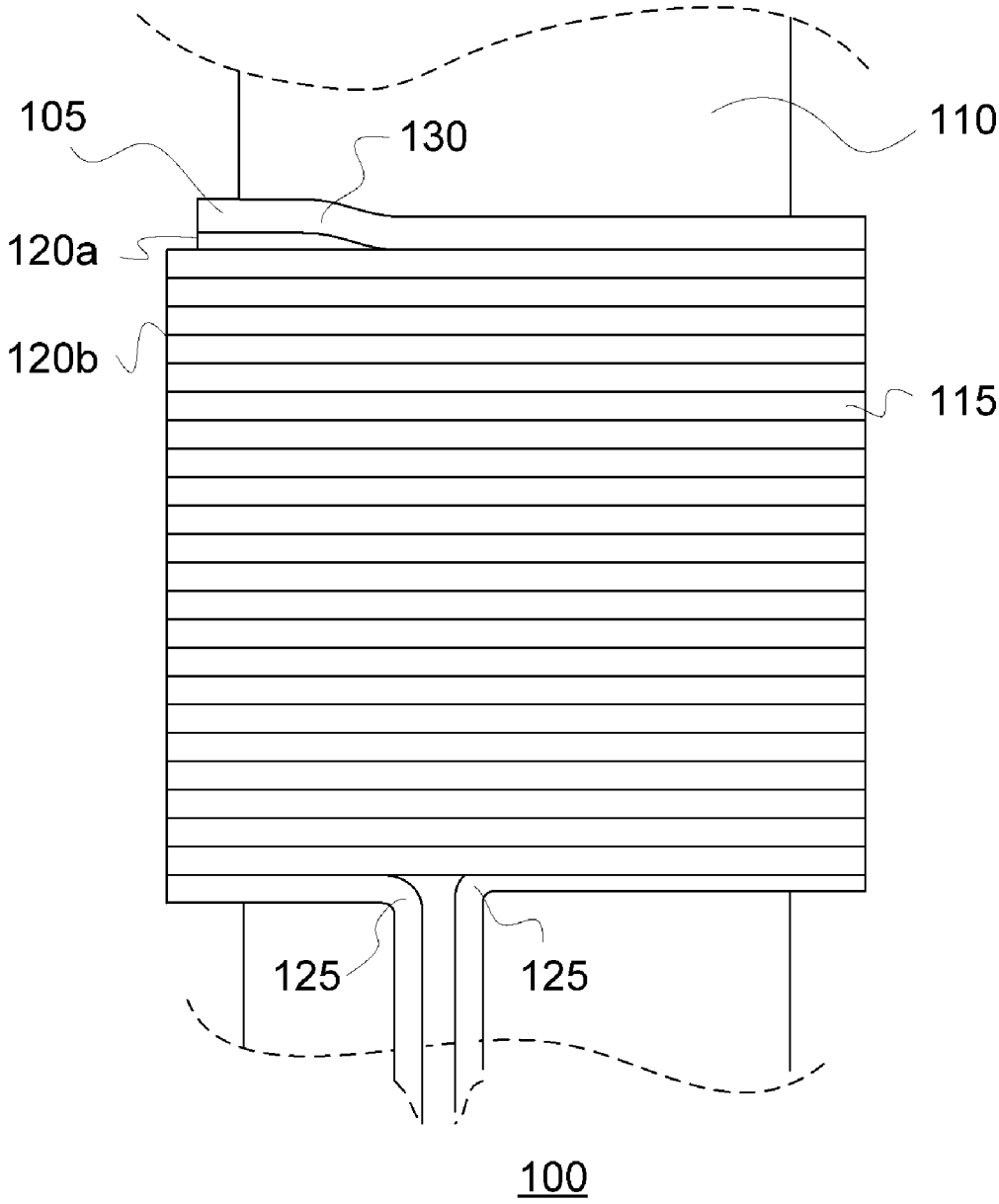
FIG. 1 is a schematic illustration of a transformer winding of two layers.
Figure 2A:
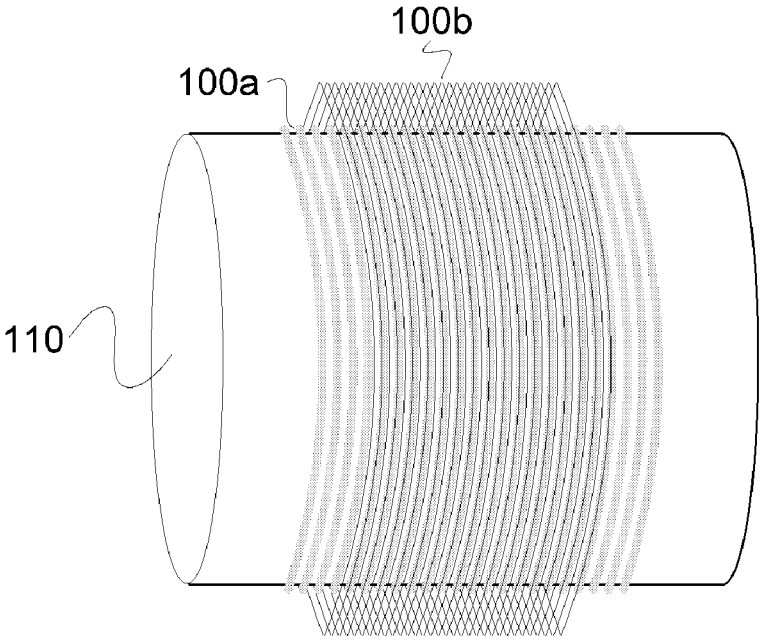
FIG. 2*a* is a perspective view schematically illustrating a transformer having two windings.
Figure 2B:
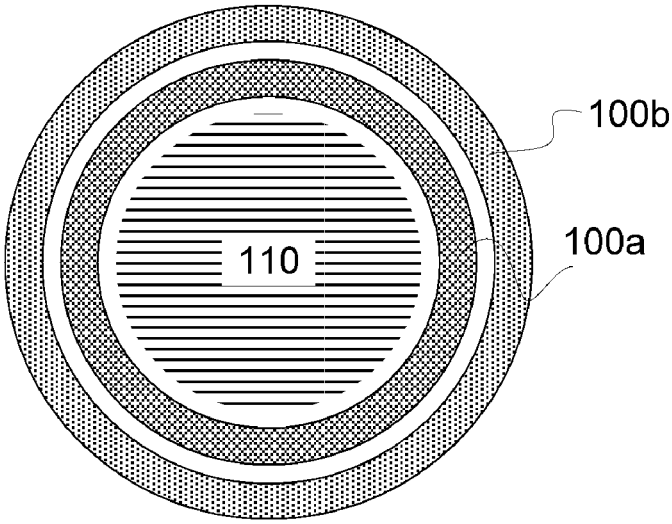
FIG. 2*b* is a cross sectional view schematically illustrating a transformer having two windings.

FIG. 1 schematically illustrates an example of a transformer winding 100 having a conductor 105 which is wound around a core 110 (the core is generally not considered to be part of the transformer winding 100). The conductor 105 forms N turns 115 around the core 110 in at least one layer 120. The transformer winding 100 of FIG. 1, which is given as an example only, has N turns divided between a first layer 120*a* and a second layer 120*b*. A layer transition 130 between the two layers 120*a* and 120*b* is shown in FIG. 1. The conductor 105 furthermore has two exit/entry transitions 125, which form transitions between the feeding parts of the conductor 105 and the part of the conductor 105 making up the coil. The winding path in a power transformer is often circular, but can alternatively be of another shape, such as for example elliptic, quadratic or rectangular. A conductor 105 is typically a cable formed of several parallel wires, but could also a single wire conductor. A schematic perspective view of a transformer 200 having an inner winding 100*a* and an outer winding 100*b* is given in FIG. 2*a*. The inner and outer windings 100*a* and 100*b* of FIG. 2*a* are wound around a circular core 110. FIG. 2*b* is a schematic cross section of the transformer 200 of FIG. 2*a*. The transformer 200 of FIG. 2 is an example only, and a transformer 200 could include more than two windings; the windings could be arranged in a different manner than that shown in FIG. 2; etc.

When a transformer 200 is in operation, the current in the outer winding 100*b* gives rise to a magnetic field which will exert a force on the current-carrying conductor 105 of the inner winding 100*a*, and vice versa. This will result an inward radial compression of the inner winding 100*a*, as well as an outward radial tension of the outer winding 100*b*. Generally, there is a risk that the compression of an inner winding 100*a* resulting from the forces on the current carrying conductor 105 of the inner winding 100*a* in a short circuit situation gives rise to unwanted deformation of the inner winding 100*a*. This risk is particularly pronounced when the inner winding 100*a* is the low voltage winding of the transformer windings, since the current flowing through the inner winding 100*a* will then be larger than when the inner winding 100*a* is the high voltage winding.

The inner winding 100*a* will hence be squeezed around the core 110 in a short circuit scenario. If no special measures are taken, this compression of the winding 100 may cause buckling of the conductor 105. In order to increase the mechanical strength of the conductor against buckling in large power transformers 200, a continuously transposed cable (CTC) is often used as the conductor 105, wherein thin, individually isolated strands are arranged in a continuously transposed fashion and bonded together, typically by epoxy. However, even if buckling can be avoided, there is still a risk that the conductor 105 of an inner winding 100*a* will be deformed in a short circuit situation. Although epoxy bonded CTC withstands high compressive or tensile stresses, it is generally not as resistant to bending stress.

When strong magnetic Lorentz forces act upon an inner winding 100*a*, the compression of the inner winding 100*a* often induces bending stress in the conductor 105 at locations where the conductor path deviates from the regular winding path around the core 110, such locations hereinafter referred to as winding transitions.

Figure 3A:
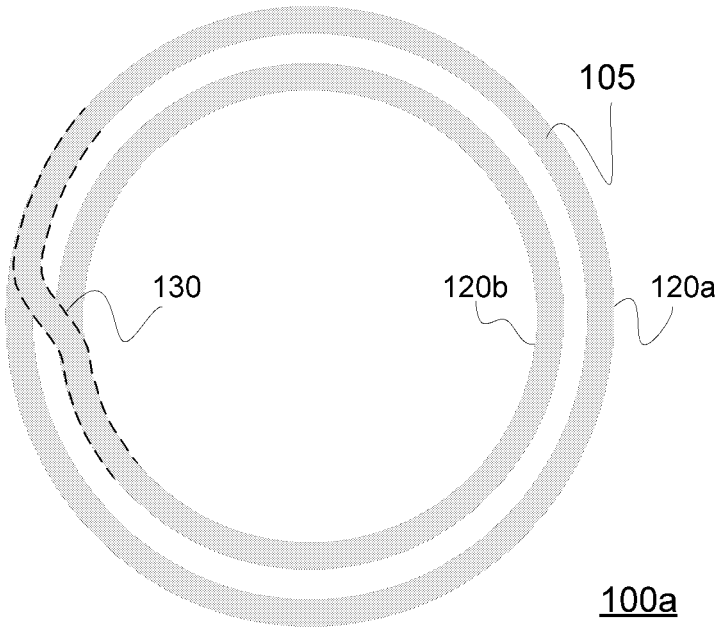
FIG. 3*a* is a view along the axis of an example of an inner winding having two layers.
Figure 3B:
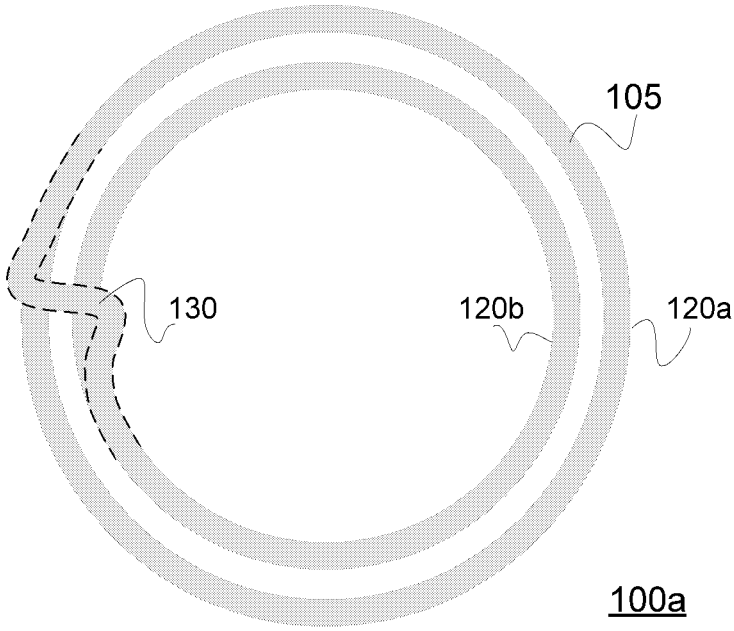
FIG. 3*b* is a view of the inner winding of FIG. 3*a* after the winding has been exposed to a short circuit scenario.

An example of a winding transition is the layer transition 130 found between two layers 120 in a multi-layer winding 100. In FIG. 3*a*, a view along the axis of an example of an inner winding 100*a* is schematically shown, where the winding 100*a* has two layers 120*a* and 120*b*, with a layer transition 130 between the layers. For illustration purposes, the conductor 105 has been indicated by hashed lines in the layer transition region. In FIG. 3*b*, a cross section of the same inner winding 100*a* is illustrated after the inner winding 100*a* has been exposed to a short circuit situation. The inner winding 100*a* of FIG. 3*b* has been deformed at the layer transition 130 by the bending stress in the conductor 105 induced by the inward radial Lorentz forces occurring during short circuit.

Figure 4B:
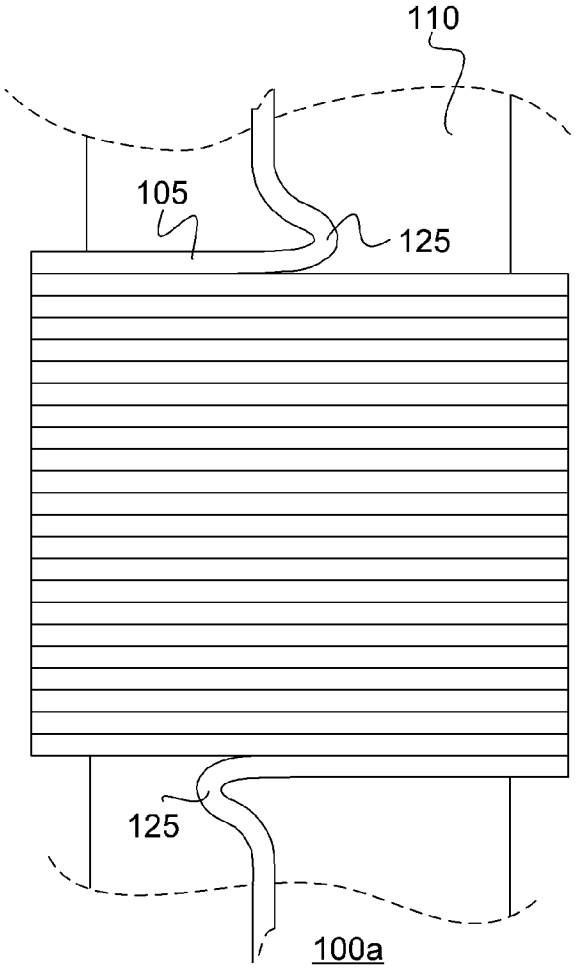
FIG. 4*b* is a schematic illustration of the inner winding of FIG. 4*a* after the winding has been exposed to a short circuit scenario.
Figure 4A:
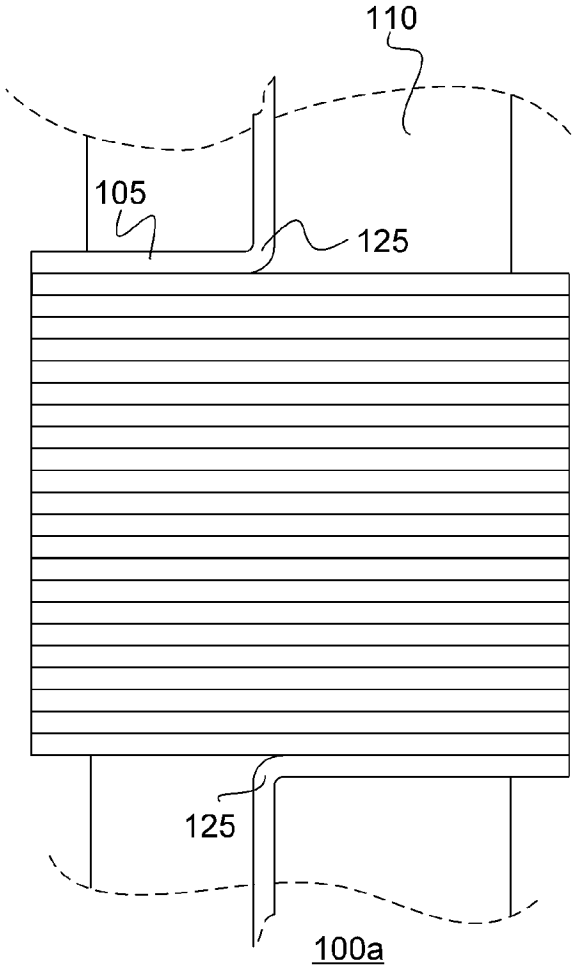
FIG. 4*a* is a schematic illustration of an inner winding of one layer.

Another example of a winding transition is the exit/entry transitions 125 between the coil and the feeding parts of the conductor 105 of a transformer winding 100. Bending stress induced by the magnetic Lorentz forces can cause a conductor 105 to form what can be referred to as the start of an extra turn at the winding exit/entry transitions 125. The short circuit bending stress at exit/entry transitions 125 is particularly pronounced in a transformer winding types referred to as helical transformer windings and layer windings, where the conductor 105 is continuously wound around the core 110 in a helix or screw fashion (cf. FIGS. 1 and 2, wherein two-layered transformer windings 100 of helical or layered type have been shown). A one-layer helical inner winding 100*a* is schematically shown in FIG. 4*a*, and the same inner winding 100*a* is schematically illustrated in FIG. 4*b* after the winding has been exposed to a short circuit situation. The conductor 105 has been deformed at the exit/entry transitions 125 by the bending stress occurring in the short circuit situation.

Figure 5B:
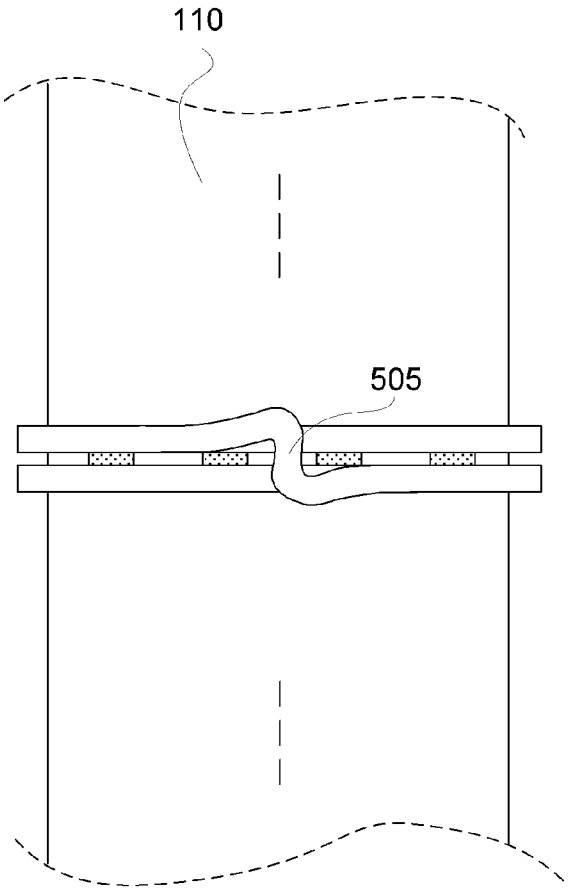
FIG. 5*b* is a schematic illustration of two discs of the inner winding of FIG. 5*a* after the winding has been exposed to a short circuit scenario.
Figure 5A:
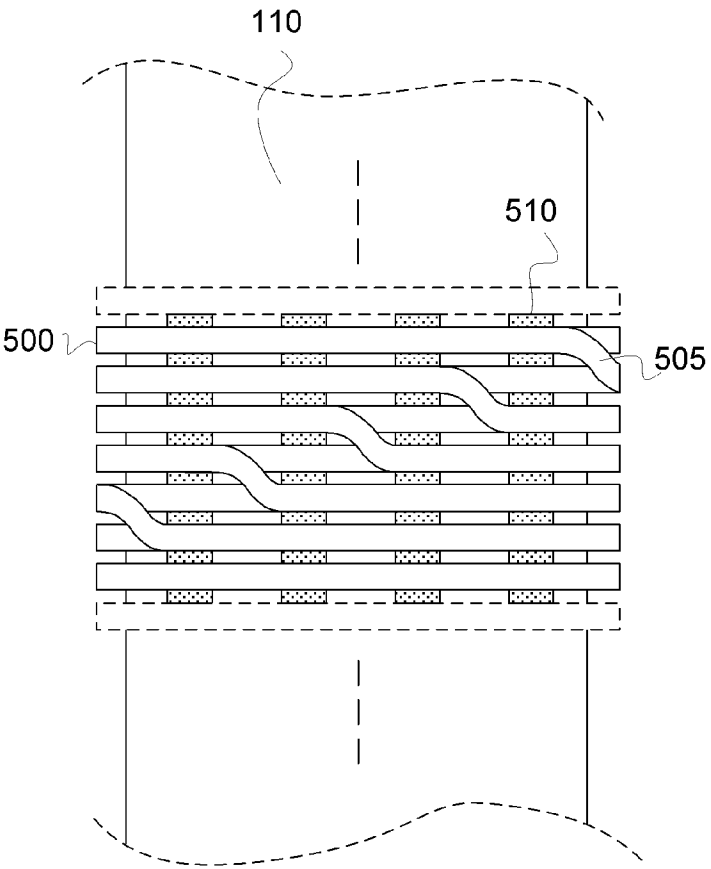
FIG. 5*a* is a schematic illustration of an inner disc winding.

A further example of a winding transition is a disc transition, i.e. a transition from one disc to another in a disc winding. An example of a transformer winding 100 comprising a plurality of discs is schematically illustrated in FIG. 5*a*. A disc winding is a type of transformer winding 100, often used for higher voltages, where the conductor 105 is wound in a plurality of turns 115 in a spiral pattern to form a transformer section 500, hereinafter referred to as a disc 500 (despite the terminology, a disc 500 could be of other shapes than circular, such as rectangular or elliptic). Many such discs 500 are typically stacked axially to form a complete winding 100. Between two adjacent discs 500, the 7 conductor 105 forms a disc transition 505. In FIG. 5*b* is illustrated a part of a disc transformer winding. The part shown includes two discs 500 connected via a disc transition 505, where the transformer winding 100 of which the discs 500 form a part has been exposed to a short circuit situation. The conductor 105 has been deformed in the disc transition region by the bending stress induced during short circuit.

As is the case in FIGS. 5*a* and 5*b*, a plurality of radial duct spacers are often placed between discs 500 directly on top of each other in the axial direction of the transformer winding 100 in order to mechanically support the transformer winding 100 in the axial direction. The radial duct spacers 510 are often placed at different locations around the winding circumference. The distance between two radial duct spacers 510 along the circumferential direction of the winding will be referred to as the duct spacer distance. Radial duct spacers 510 are often used also in other types of windings, for example between turns 115 in a helical transformer winding 100, although some transformer windings 100 do not have any radial duct spacers 510.

Deformation of the conductor 105 as discussed in relation to FIGS. 3-5 can degrade the dielectric strength as well as the stress tolerance of the winding 100. Furthermore, there is a risk that the function of any support structure for holding the conductor 105 in place will be degraded if the exit/entry transitions 125 of the winding 100 move.

Figure 6B:
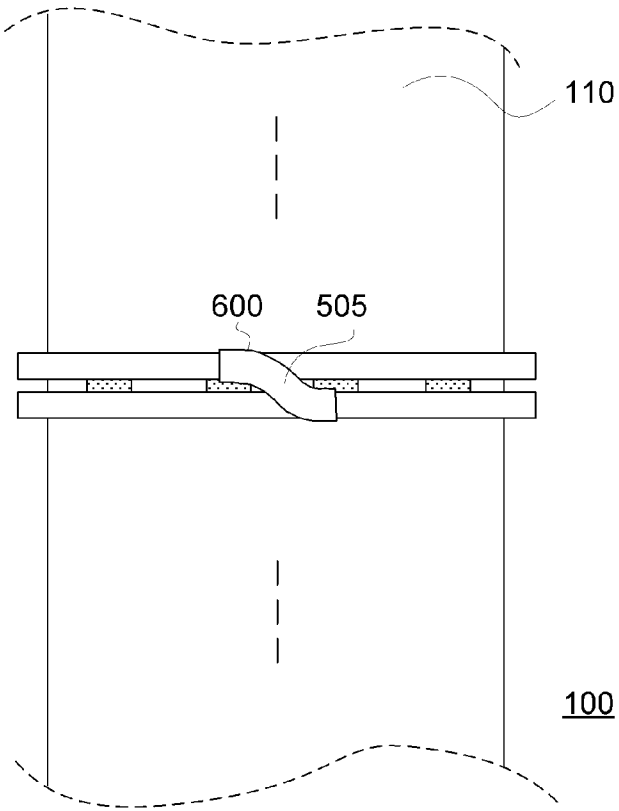
FIG. 6*b* is a schematic illustration of two discs of a disc winding wherein a disc transition between the two discs has been reinforced by a reinforcing part.
Figure 6A:
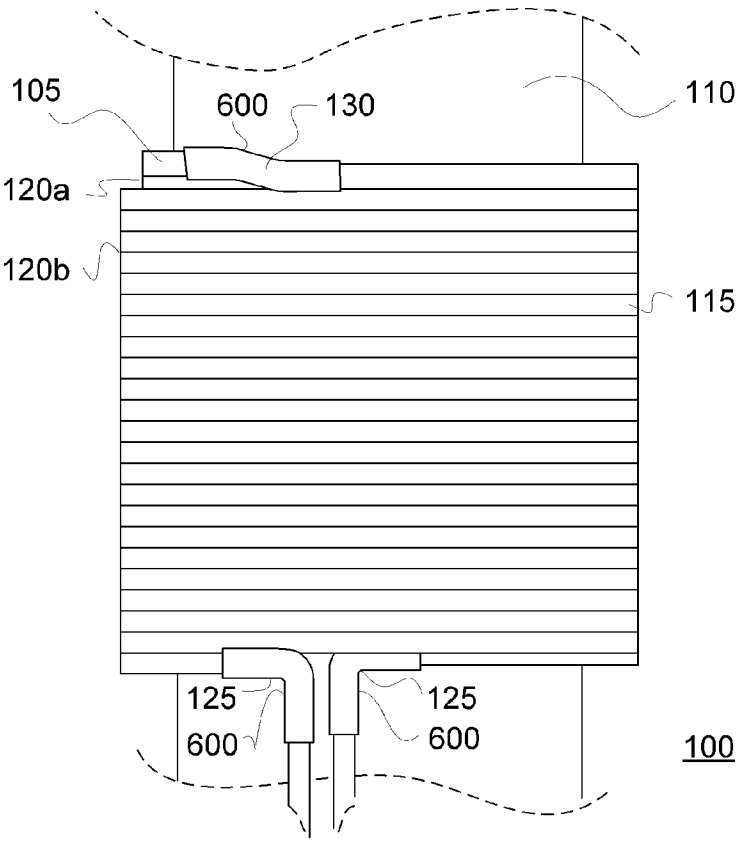
FIG. 6*a* is a schematic illustration of a two layer transformer winding wherein a layer transition, as well as the exit/entry transitions 125, have been reinforced by means of reinforcing parts.

In order to reduce the negative impact on a transformer winding 100 of inward radial forces, a reinforcing part could be applied to the conductor 115 at winding transitions where such forces would induce high bending stress. Two examples of transformer windings 100 to which reinforcing parts 600 have been applied are shown in FIGS. 6*a* and 6*b*, respectively. The transformer windings 100 shown in FIGS. 6*a* and *b* are examples only, and other types of transformer windings may also benefit from having one or more reinforcing parts 600. In FIG. 6*a*, a two-layer helical transformer winding 100 is shown, wherein reinforcing parts 600 have been applied to the layer transition 130, as well as to the conductor exit/entry transitions 125. In FIG. 6*b*, a part of a disc transformer 100 is shown, wherein a reinforcing part 600 has been applied to a disc transition 505 between two adjacent discs 500.

Reinforcing parts 600 could be made from an insulating material having suitable properties in terms of tensile and compressive strengths, and tensile elasticity. A component providing semi-conducting properties to the reinforcing part 600 could also be included, as is further discussed in relation to FIG. 10. Generally, a material of high yield strength and a high value of Young's modulus would be suitable in order to efficiently increase the bending strength of the transformer winding 100. High strength polymers and fibre reinforced polymers are examples of suitable materials. Suitable polymers to be reinforced are for example thermosetting polymers such as epoxy, vinyl ester, polyester, nylon etc. Examples of suitable reinforcing fibres are glass fibre, carbon fibre, para-aramid fibres etc.

A reinforcing part 600 could advantageously be provided at a winding transition, such as for example at conductor exit/entry transitions 125 (for example in a helical or layered winding), at layer transitions 130 in a multi-layer winding, at transitions between discs in a disc transformer winding, etc. A reinforcing part 600 could also be provided at other parts of a winding conductor 105 where increased bending strength would be beneficial.

Figure 7A:
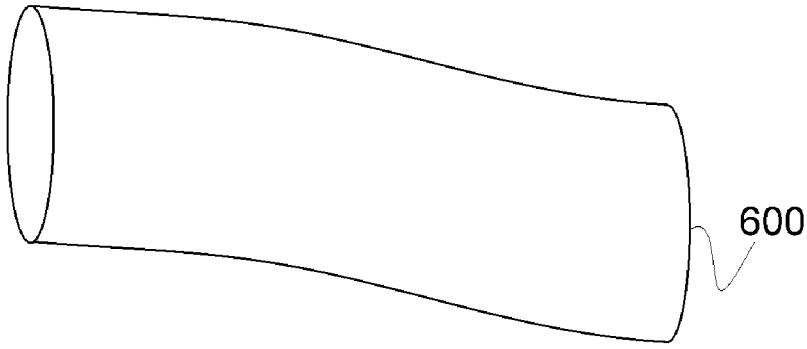
FIG. 7*a* is a schematic illustration of a reinforcing part in the shape of a whole tube.
Figure 7B:
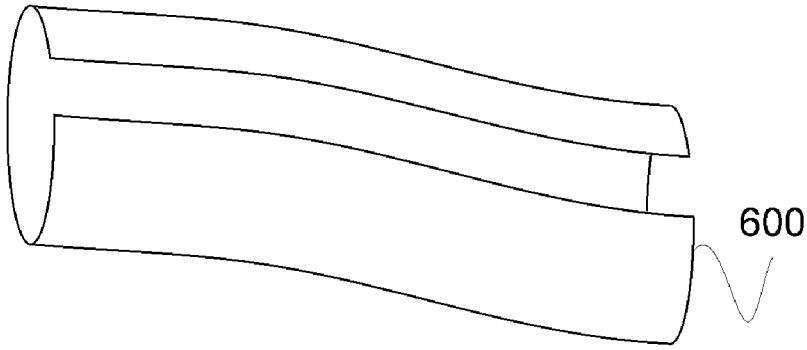
FIG. 7*b* is a schematic illustration of a reinforcing part in the shape of a partial tube.

A reinforcing part 600 could be in the shape of a tube surrounding the conductor 105 along its circumference, either wholly or partially. A tubiform reinforcing part 600 could be in the shape of a whole tube, covering 360 degrees of the conductor 105 circumference, or in the shape of a partial tube, covering less than 360 degrees of the conductor circumference. If a reinforcing part 600 in the shape of a partial tube is used, the reinforcing part 600 should preferably be positioned so that a minimum of bending stress will be experienced along the part of the conductor circumference which is not covered by the reinforcing part 600. An example of a reinforcing part 600 in the shape of a whole tube is schematically shown in FIG. 7*a*, while an example of a reinforcing part in the shape of a partial tube is shown in FIG. 7*b*. The reinforcing parts 600 of FIGS. 7*a* and 7*b* are shown to be of smooth shape with even edges. However, more rough tubes may also be used.

The inner circumference of the reinforcing part 600 could advantageously be of the same or similar shape as the circumference of the conductor 105, so that the reinforcing part 600 lies close to the conductor 105. The reinforcing parts 600 of FIGS. 7*a* and 7*b* are shown to be of circular circumference. However, oftentimes the cross section of the conductor 105 is of a non-circular shape, such as of rectangular, elliptic or an approximate rectangular shape. A CTC conductor, for example, typically has an approximate rectangular shape where a deviation from a rectangular cross section is caused by the transposing of strands. A reinforcing part 600 to be used to reinforce the bending strength of a conductor 105 of rectangular circumference could advantageously have a rectangular (inner) circumference, and so forth. In one embodiment, the reinforcing part 600 adheres to the surface of the conductor 105, while in another embodiment, the conductor 105 and the reinforcing part 600 do not adhere to each other.

Figure 8A:
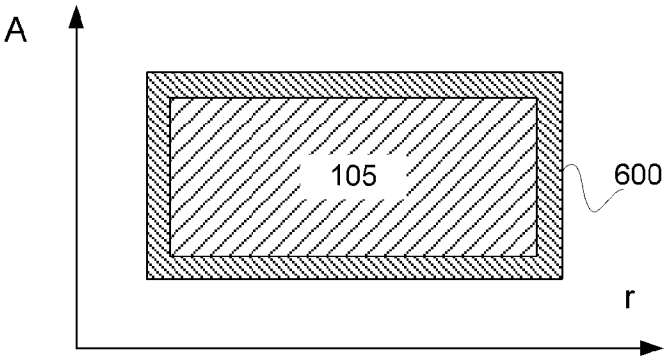
FIG. 8*a-d* are schematic cross sections of different embodiments of reinforcing parts for reinforcing a conductor of rectangular cross section.
Figure 8B:
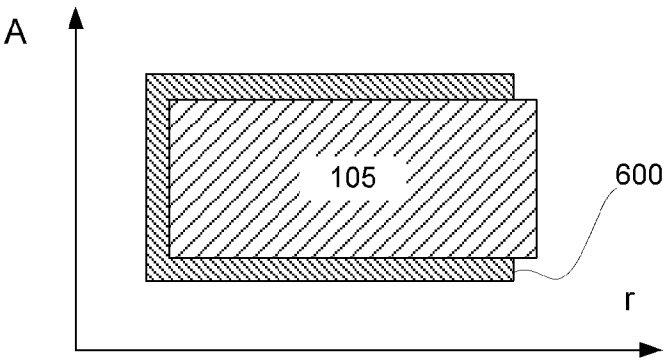
Figure 8C:
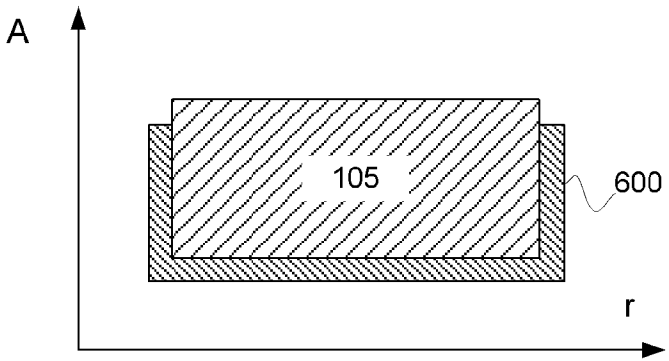
Figure 8D:
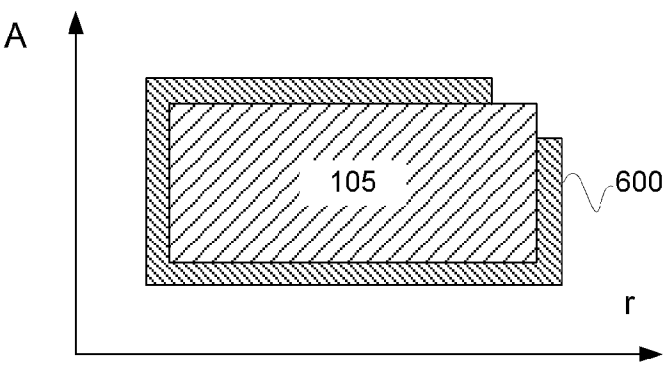

In FIG. 8*a-d*, cross sections of different examples of reinforcing parts 600 for reinforcing a rectangular conductor 105 are shown. An axis A indicating the direction of the axis of the winding 100 of which the conductor forms a part is shown in the drawings, as well as an axis r indicating the radial direction of the winding 100. In FIG. 8*a*, a reinforcing part in the shape of a whole rectangular tube is shown. This shape of the reinforcing part 600 is suitable for reinforcing the rectangular conductor 105 at any location. However, for example for reasons of ease of mounting the reinforcing part 600 on the conductor 105, it might sometimes be desirable to use a reinforcing part 600 in the shape of a partial tube. In FIG. 8*b*, a reinforcing part 600 by which three sides of the rectangular conductor 105 are at least partly covered, in a manner so that a short side of the conductor 600 is not covered, is illustrated. This shape of the reinforcing part 600 is suitable for reinforcing a part of the conductor 105 where the long sides of the conductor cross section experience a higher risk of being exposed to bending stress, such as in a disc transition 130, or in an entry/exit transition 125 when the conductor 105 enters/exits the winding 100 in the axial direction of the winding. In FIG. 8*c*, a reinforcing part 600 is illustrated by which three sides of the rectangular conductor 105 are at least partly covered, in a manner so that a long side of the conductor 600 is not covered. This shape of the reinforcing part 600 is suitable for reinforcing a part of the conductor 105 where the short sides of the cable cross section experience a higher risk of being exposed to bending stress, such as in a layer transition 130, or in an entry/exit transition 125 when the conductor 105 enters/exits the winding 100 in the radial direction of the winding. In FIG. 8*d*, a reinforcing part 600 is shown having a shape where all four sides of the rectangular conductor 105 are at least partly covered in a manner so that a corner of the conductor 105 is not covered by reinforcing part 600. This shape of reinforcing part 600 is suitable for application at all locations of the conductor 105.

Figure 8E:
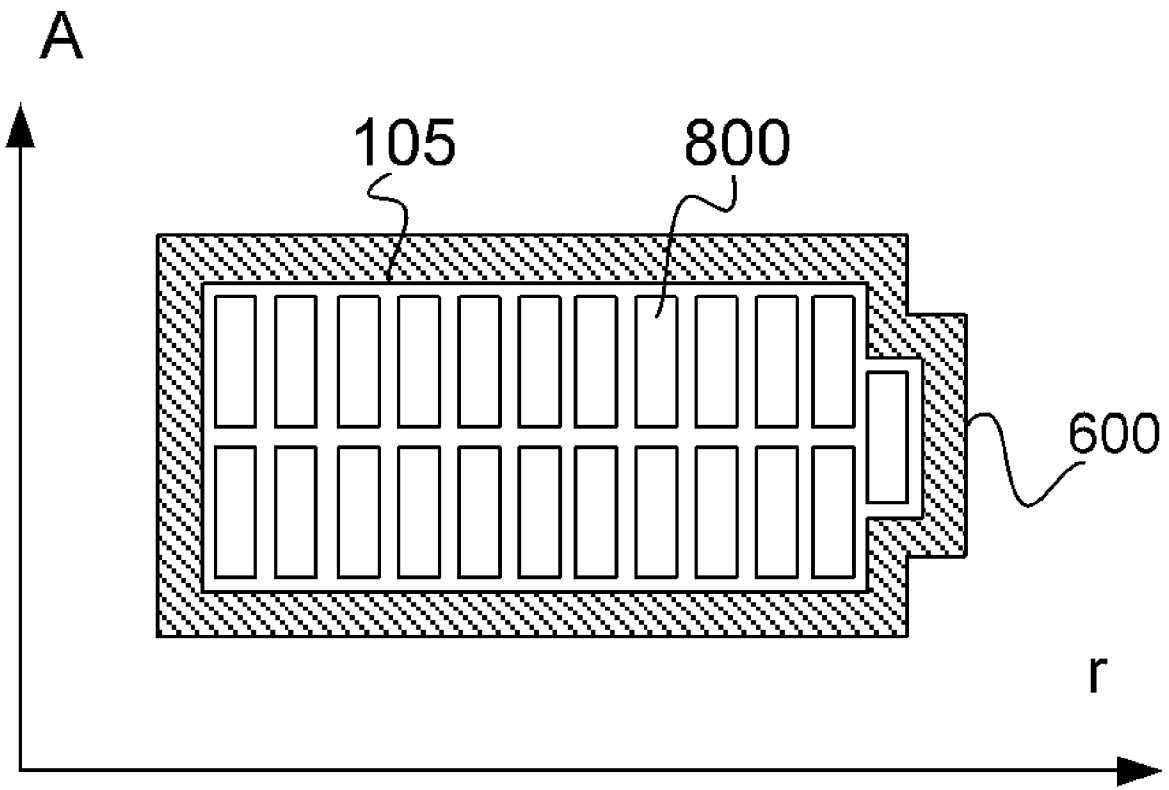
FIG. 8*e* is a schematic cross section of an embodiment of a reinforcing part for reinforcing an example of a CTC conductor.

Although the conductor 105 of FIG. 8*a-d* is rectangular, the above discussion also holds for approximately rectangular conductors 105 such as CTC conductors. An example of a CTC conductor 105 which is reinforced by means of a whole reinforcing part 600 is schematically shown in FIG. 8*e*, the CTC conductor 105 comprising conducting strands 800.

Regardless of conductor shape, the reinforcing part 600 should generally cover at least 180 degrees of the conductor circumference in order to provide sufficient reinforcement of the conductor 105. If 360 degrees of the circumference is covered, the thickness and/or the axial length of the reinforcing part 600 could typically be smaller while maintaining the same reinforcement enhancement than if a partial tube is used. In one embodiment, the reinforcing part comprises two or more partial tubes, together covering at least 180 degrees of the conductor circumference and forming a split reinforcing part 600. One or more of the partial tubes of such split reinforcing part could cover less than 180 degrees of the conductor circumference. Such partial tubes of a split reinforcing part 600 could be held in place for example by grooves on the conductor 105; by a strong adhesive tape, etc.

The bending strength of a conductor 105 is the upper limit of normal stress of the conductor 105 at which fracture or excessive plastic deformation occurs, and can be defined as the product of the limit strength (yield point or ultimate strength) and the section modulus of the conductor 105. The bending strength can for example be measured by means of a 3-point bending test or a cantilever bending test, both of which are well known in the art.

Depending for example on the dimensions of conductor 105; the tensile and compressive strengths of the material used for the reinforcing part 600; and the magnitude of the bending moment M expected in case of short circuit, a suitable thickness of the reinforcing part 600 can be selected. An increase in bending strength of 50% or more is often desired at the winding transition as compared to the parts of the conductor 105 which have not been reinforced, although in some situations, a smaller increase in bending strength might be sufficient, and the dimensions of the reinforcing part 600 could be selected accordingly. Typically, an increase in bending strength of at least 25% is desired in order to make sure that the bending strength of the conductor 105 will not be the limiting factor when dimensioning a transformer 200. Mechanical tests have been performed on a winding transition of a conductor 105 of dimension 30 mm×18 mm. The conductor 105 of this test was wrapped with glass fibre reinforced tape impregnated with semi-cured epoxy, which was then cured. A reinforcing part 600 of thickness of around 2-3 mm approximately doubled the bending strength of the thus reinforced conductor at the winding transition.

When a reinforcing part 600 is applied to a winding transition wherein the conductor path deviates from the regular (often circular) winding path to form a bend in the conductor 105, the reinforcing part 600 could advantageously extend, in the axial direction of the conductor 105, beyond the bend in the conductor 105. A reinforcing part 600 does not have to extend over the same distance in both directions from the winding transition, although this might often be the case. However, the reinforcing part 600 typically extends along the axial direction of the conductor 105 by at least one conductor diameter in each direction. (when the conductor 105 is of rectangular cross section, the length of a diagonal could be seen as the diameter). In some implementations, the reinforcing part 600 could extend over a distance corresponding to a quarter of a turn 115 in each direction from the winding transition (or more); in other implementations, the reinforcing part could extend over 1/40 of a turn 115 in each direction (or less). Typically, for a larger winding 100, the reinforcing part 600 could extend over a smaller part of a turn 115. In transformer windings 100 wherein duct spacers 510 are used to separate different discs 500 or turns 115, the reinforcing part 600 could for example extend beyond the duct spacers 510 which are adjacent to the winding transition to be reinforced, so that the reinforcing part 600 extends over a length approximately corresponding to 1-4 times the circumferential duct spacer distance. In this way, the reinforcing part 600 will cover the part of the conductor 105 that is subject to the highest bending stress in case of a short circuit. The duct spacers 510 provide mechanical support for the conductor 105 such that the bending stress is considerably lower one duct spacing away from the winding transition. If the reinforcing part 600 for example reinforces the conductor 105 at a winding transition located between two duct spacers 505, the reinforcing part will, if it extends approximately 1-4 duct spacer distances, cover the part of the conductor 105 that is subject to the highest bending stress in case of a short circuit. By the reinforcement part 600 covering approximately 2 duct spacer distances, the duct spacers often provide sufficient support for the conductor 105.

Other lengths of the reinforcing part 600 could be used—shorter or longer than in the examples given above—depending on the bending properties of the reinforcing part 600 and the conductor 105, as well as on the magnitude of the bending moment M expected in case of short circuit.

In order to form a reinforcing part 600 of fibre reinforced thermosetting polymer, the reinforcing part 600 could for example be formed by applying, to the conductor 105, a fibre tape, fibre mat, or similar, which has been pre-impregnated with a thermosetting polymer. Alternatively, the reinforcing fibres and a thermosetting polymer could be applied to the conductor 105 separately, in which case the fibre is often applied first, for example in the form of a roving, a unidirectional fibre thread, a woven fabric or similar. The thermosetting polymer is then typically applied after the fibre, and could be applied by means of for example a brush, a paint roller, spraying, injection, pouring into a temporary form, etc.

Figure 9A:
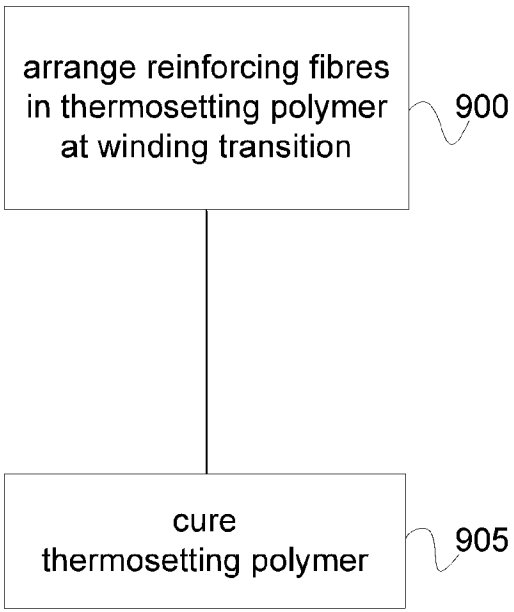
FIG. 9*a* is a flowchart schematically illustrating an example of a method of producing a reinforced winding transition.

FIG. 9*a* is a flowchart schematically illustrating an example of a method of producing a reinforced winding transition made of a fibre reinforced polymer. In step 900, reinforcing fibres in a thermosetting polymer are arranged at the winding transition to form a reinforcing part 600 of a suitable shape. At step 910, the thermosetting polymer is cured. Curing of the thermosetting polymer could for example be performed at the same time as the hot drying of the winding 100 or of the finished transformer 200 (normally, the transformer core 110 is dried after the windings 100 have been put in position). Hence, an additional curing step would typically not be needed.

Figure 9B:
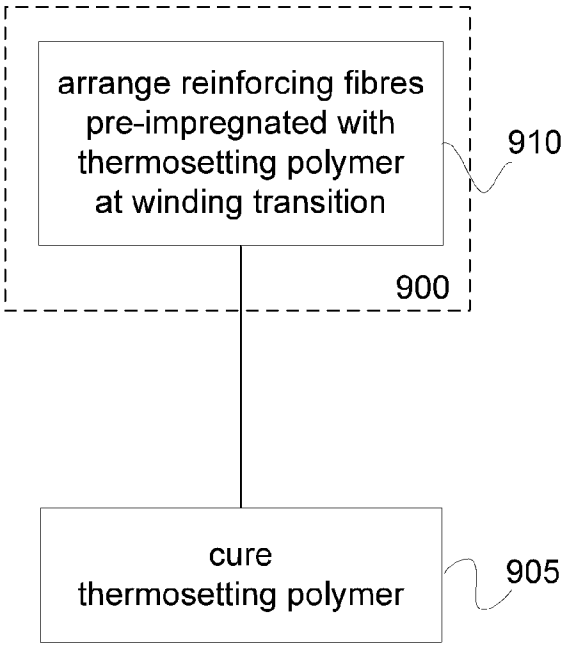
FIG. 9*b* is a flowchart schematically illustrating an embodiment of the method of FIG. 9*a*.
Figure 9C:
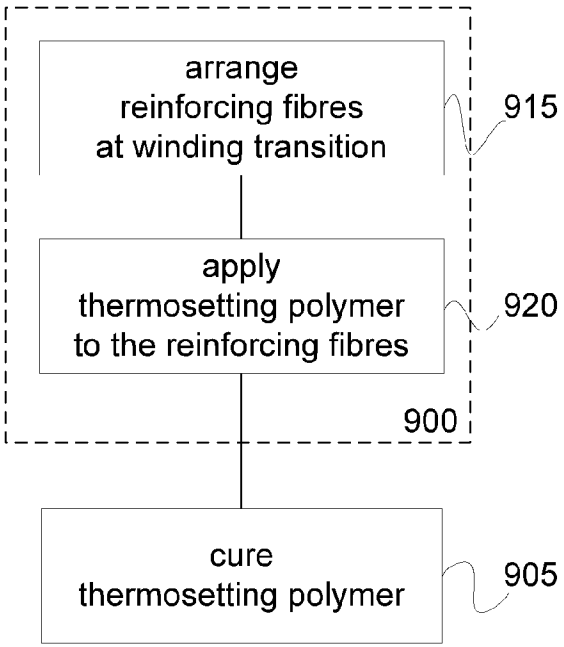
FIG. 9*c* is a flowchart schematically illustrating another embodiment of the method of FIG. 9*a*.

FIG. 9*b* is a flowchart schematically illustrating an embodiment of the method shown in FIG. 9*a*. In this embodiment, step 900 includes the step 910 of arranging reinforcing fibres which have been pre-impregnated with a thermosetting polymer at the winding transition. Step 905 is then entered. The pre-impregnated reinforcing fibres could for example be in the form of a pre-impregnated fibre tape or fibre mat. FIG. 9*c* is a flowchart schematically illustrating another embodiment of the method shown in FIG. 9*a*, wherein step 900 comprises the steps 915 and 920. In step 915, reinforcing fibres are arranged at the winding transition, while at step 920, a thermosetting polymer is applied to the reinforcing fibres. The reinforcing fibres could for example be in the form of a roving, a unidirectional fibre thread, a woven fabric or similar.

A reinforcing part 600 could alternatively be cured prior to applying the reinforcing part to the winding transition, i.e. step 905 of FIG. 9*a* could be performed prior to step 900. Step 905 would then be preceded by a further step of forming a fibre reinforced polymer into the shape of a reinforcing part 600. For example, a reinforcing part 600 of suitable shape could be made in a mould in a conventional manner. The reinforcing part 600 could then be applied to the conductor 600 after the reinforcing part 600 has been cured. This could for example be suitable for reinforcing parts 600 to be applied to exit/entry transitions 125, where the conductor 105 could be passed through the reinforcing part 600 after the turns 115 of the transformer winding 100 have been wound; or for reinforcing parts 600 in the shape of a partial tube that could be slipped on to the conductor 105.

Reinforcing parts 600 could alternatively be made from a polymer which is not cured, and/or which is not fibre reinforced. Moreover, other insulating materials could be used as the main component of a reinforcing part 600.

Figure 10:
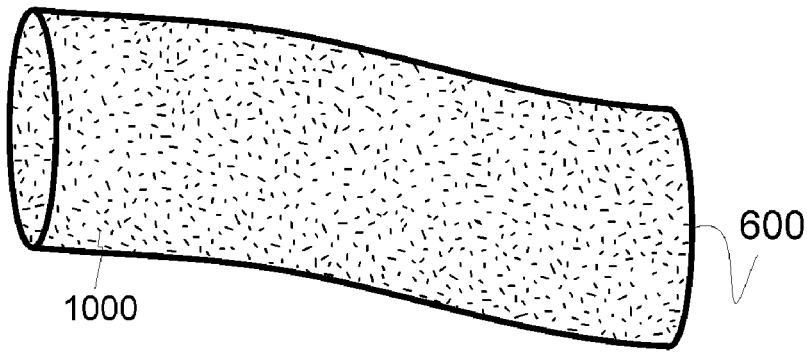
FIG. 10 is a schematic illustration of a polymer reinforcing part comprising a component yielding semi-conducting properties.

In one embodiment, the reinforcing part 600 comprises a component providing semi conductive properties to the reinforcing part 600. Generally, there is a risk that gas bubbles will form inside a polymer upon forming the polymer into a suitable shape. The presence of gas bubbles will increase the risk for partial discharges when the transformer winding 100 is subject to high voltages. A shielding property of a polymer reinforcing part 600 can for example be achieved by mixing the polymer with a component providing semi conductive properties to the reinforcing part 600, so that gas bubbles in the polymer, if any, will be shielded by this component. The risk for partial discharges in gas bubbles in the polymer will thus be reduced. Hence, by mixing the polymer with a component providing semi-conductive properties, the demands on the polymer application or moulding process can be less strict. A semi-conductive polymer can for example be achieved by mixing a polymer with carbon powder, a metallic powder or similar, prior to forming the polymer into a suitable shape. An example of a polymer reinforcing part 600 wherein the polymer has been mixed with a powder 1000 providing semi-conductive properties is shown in FIG. 10. The component providing semi-conductive properties could have been pre-added to the polymer of a fibre-reinforced polymer tape, roving or similar (cf. step 910 of FIG. 9), or could have been added to a polymer prior to performing step 920 of FIG. 9. An alternative way of obtaining a shielding property of the reinforcing part 600 is to provide a layer of a suitable semi-conductive material, for example a layer of carbon paper, around the reinforcing part 600. The semi-conductive properties of the reinforcing part 600 should preferably be such that sufficient electrical conductivity is achieved for providing potential-equalization with respect to an electrical field exterior to the reinforcing part 600. However, the conductivity of the reinforcing part 600 should not be large enough to contribute to induction of voltages.

When the reinforcing part 600 exhibits semi-conductive properties, electrical contact could advantageously be made between the reinforcing part 600 and the conductor 105, so that the reinforcing part will be at the same electrical potential as the conductor 105. For example, insulating coating covering the conductor 105 could be removed at a location which is covered by the reinforcing part 600.

The present invention is applicable to all transformers 200 which are exposed to a risk for deformation of the winding conductor 105 caused by bending stress. The invention is for example useful in large power transformers, such as power transformers having an electrical rating of 25 MVA or higher, for example generator step-up transformers of rating 100 MVA or more, but could also be useful in smaller transformers. In the above, the description has mainly been given in relation to bending stress induced by magnetic Lorentz forces in a short circuit situation. However, the invention could also be used to reduce the risk of deformation of a conductor 105 of a transformer winding 100 caused by bending stress in other situations.

Although various aspects of the invention are set out in the accompanying independent claims, other aspects of the invention include the combination of any features presented in the above description and/or in the accompanying claims, and not solely the combinations explicitly set out in the accompanying claims.

One skilled in the art will appreciate that the technology presented herein is not limited to the embodiments disclosed in the accompanying drawings and the foregoing detailed description, which are presented for purposes of illustration only, but it can be implemented in a number of different ways, and it is defined by the following claims.

What is claimed is:

1. A transformer winding having a conductor wound in a plurality of turns, the transformer winding comprising a reinforcing part arranged at a winding transition of the conductor in a manner so that the reinforcing part covers more than 180 degrees of the conductor circumference, whereby the bending strength of the conductor at the location of the winding transition is increased.

2. The transformer winding according to claim 1, wherein the main component of the reinforcing part is a fibre reinforced polymer.

3. The transformer winding according to claim 1, wherein the reinforcing part increases the bending strength of the conductor by at least 25% at the location of the winding transition.

4. The transformer winding according to claim 1, wherein the reinforcing part extends, in the axial direction of the conductor, a distance corresponding to less than a circumference of a winding turn.

5. The transformer winding according to claim 1, wherein the transformer winding comprises a plurality of radial duct spacers spaced at a duct spacer distance along the circumferential direction of the winding, and wherein the reinforcing part extends, in the axial direction of the conductor, a distance corresponding to 1-4 duct spacer distances.

6. The transformer winding according to claim 1, wherein the reinforcing part includes a component providing semi-conducting properties to the reinforcing part so that electrical shielding of the reinforcing part is achieved.

7. The transformer winding according to claim 1, wherein the conductor is a continuously transposed cable conductor.

8. A transformer including the transformer winding according to claim 1.

9. The transformer according to claim 8, wherein the transformer winding forms an inner winding of the transformer.

10. The transformer according to claim 8, wherein the transformer winding forms a low voltage winding of the transformer.

11. The transformer according to claim 8, wherein the transformer is a power transformer designed to have an electrical power rating of 25 MVA or higher.

12. A method of increasing the bending strength of a transformer winding having a conductor, wherein reinforcing fibres in a thermosetting polymer are arranged at a winding transition in a manner so that the reinforcing fibres form a reinforcing part extending around more than 180 degrees of the circumference of the conductor at least part of the winding transition.

13. The method according to claim 12, wherein the step of arranging comprises arranging reinforcing fibres which have been pre-impregnated with a thermosetting polymer at the winding transition to form said reinforcing part.

14. The method according to claim 12, wherein the thermosetting polymer comprises a semi-conducting component arranged to provide electrical shielding to the reinforcing part.

15. The method according to claim 12, wherein curing of the reinforcing part is performed upon hot drying of the transformer winding, or of a transformer of which the transformer winding forms a part.

* * * * *